United States Patent [19]

Hummel

[11] 4,311,900

[45] Jan. 19, 1982

[54] HEATER BAND

[75] Inventor: Matt N. Hummel, Glenview, Ill.

[73] Assignee: Acra Electric Corporation, Schiller Park, Ill.

[21] Appl. No.: 115,092

[22] Filed: Jan. 18, 1980

Related U.S. Application Data

[62] Division of Ser. No. 930,684, Aug. 3, 1978, Pat. No. 4,204,316.

[51] Int. Cl.[3] ..... H05B 3/58

[52] U.S. Cl. ..... 219/535; 29/613; 219/530; 219/540; 219/541; 219/544; 338/249

[58] Field of Search ..... 219/528, 530, 535, 540, 219/541, 544; 29/61 N, 611, 613, 618, 619; 338/244, 249

[56] References Cited

U.S. PATENT DOCUMENTS

| | | | |
|---|---|---|---|
| 1,150,326 | 8/1915 | Hardaway, Jr. | 29/613 X |
| 1,993,410 | 3/1935 | Lightfoot | 28/618 X |
| 2,740,035 | 3/1956 | Young, Jr. | 219/535 |
| 2,801,321 | 7/1957 | Prindle | 219/535 X |
| 2,875,312 | 2/1959 | Norton | 219/535 |
| 2,992,314 | 7/1961 | Drugmand et al. | 219/535 |
| 3,045,098 | 7/1962 | Norton | 219/535 |
| 3,808,573 | 4/1974 | Cappell | 338/249 |
| 3,872,281 | 3/1975 | Krieg et al. | 219/535 |
| 3,912,907 | 10/1975 | Lodi | 219/535 |
| 4,203,197 | 5/1980 | Crandall | 29/611 |

FOREIGN PATENT DOCUMENTS

| | | | |
|---|---|---|---|
| 2338732 | 2/1975 | Fed. Rep. of Germany | 219/535 |
| 71437 | 4/1915 | Switzerland | 219/535 |

*Primary Examiner*—Volodymyr Y. Mayewsky
*Attorney, Agent, or Firm*—Wegner, Stellman, McCord, Wood & Dalton

[57] ABSTRACT

A heater band formed of an extruded metal channel member and a heater plate assembly received within a slot extending along the length of the channel. The heater plate assembly and the extrusion are compressed together to provide a heater band having a dense cross section resulting in improved heat transfer characteristics. The heater band in accordance with the present invention has a longer life and higher heating capabilities than heater bands known to the prior art.

6 Claims, 8 Drawing Figures

HEATER BAND

This is a division, of application Ser. No. 930,684 filed Aug. 3, 1978, now U.S. Pat. No. 4,204,316.

BACKGROUND OF THE INVENTION

This invention relates to electric heating and, more specifically, to an improved heater band and a method for making the band.

Heater bands are known for heating a container, as for example an extruder barrel containing a plastic melt or a water heater. Such a heater band is disclosed in Browne U.S. Pat. No. 2,976,387, owned by the assignee of the present invention. The heater band includes a heating element carried by and electrically insulated from a cover and a base, both of thin sheet metal. The base includes tabs or flanges which are folded over the cover to retain the electric heating element between the cover and the base. The sheet metal is of low mass, and when the underside of the base is in intimate contact with the container to be heated, satisfactory heat transfer from the heater band to the container takes place.

Two related problems arise with the heater band described above. First, if the band separates from the barrel creating a space therebetween, the heat transfer from the heating element to the container is reduced and the heating element becomes overheated since the sheet metal cannot sufficiently and adequately absorb the additional heat which was not dissipated as a result of inefficient heat transfer between the heating element and the container. This reduces the operational life of the heating element. Second, the wattage of the heating element must be selected to be less than the maximum possible wattage to assure that the heating element does not burn out if the band separates from the container.

SUMMARY OF THE INVENTION

In accordance with the present invention, a heater band is provided having a compressed, thick cross section to dissipate large amounts of heat so that the need for maintaining the heater band in intimate contact with the container to be heated is not as critical as with prior heater bands. The heater band includes a metal channel member having a slot which extends along its length and a heater plate assembly received within the slot. The channel member is preferably a metal extrusion, as of aluminum. The heater plate assembly is formed by securing a heating element to a thick metal cover plate. The heater plate assembly is slid into the channel member slot. The channel member and the heater plate assembly are then compressed to assure intimate contact therebetween and good heat transfer from the heating element to the channel member.

It is a feature of the invention that the heater band has a dense cross section and sufficient mass to dissipate the heat from the heating element so that the element will not burn out if heat transfer from the heater band to an adjacent container is disrupted.

Another feature is that the heater band may have higher wattage for a given size than heretofore practical without decreasing the operational life of the band.

Yet another feature of the present invention is the method of manufacturing the heater band in which the parts are of relatively thick metal and are compressed to provide the improved characteristics described above.

DRAWINGS

FIG. 1, prior art, is a perspective view of a container, as an extruder barrel, having heater bands known to the prior art.

FIG. 2, prior art, is a cross-sectional view taken through the line 2—2 of FIG. 1;

Figure 6:
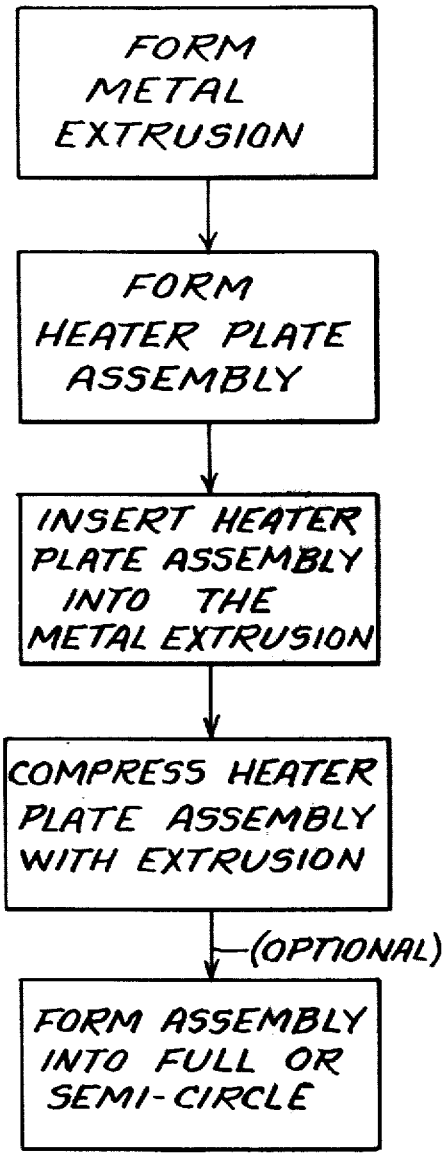
Figure 7:
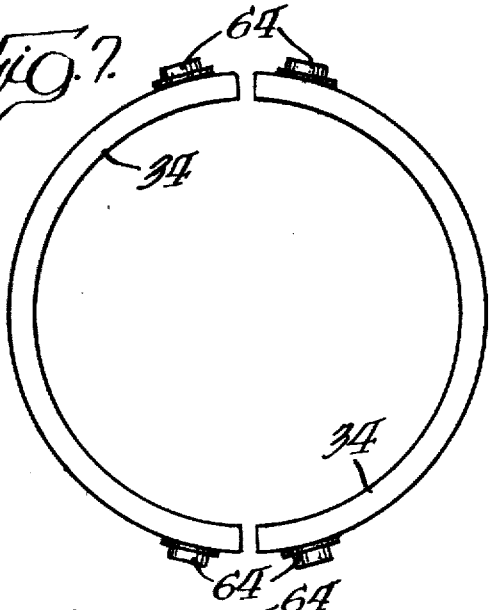
Figure 8:
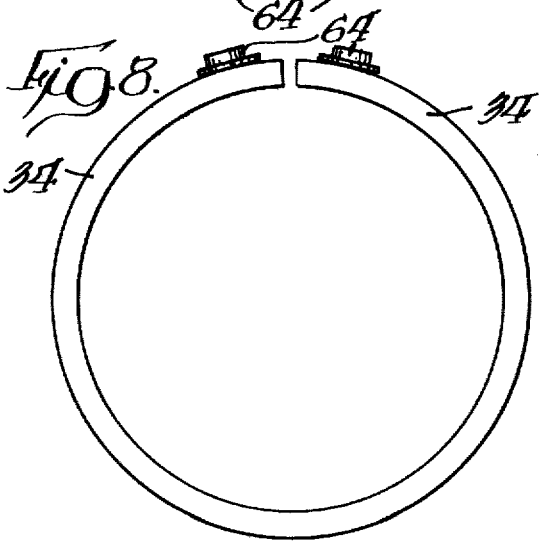

FIG. 6 outlines the method steps in making the heater band;

FIG. 7 is a diagrammatic view showing the heater band in semicircle form; and FIG. 8 is a diagrammatic view showing the heater band formed in a circle.

DESCRIPTION OF THE PRIOR ART

Figure 1:
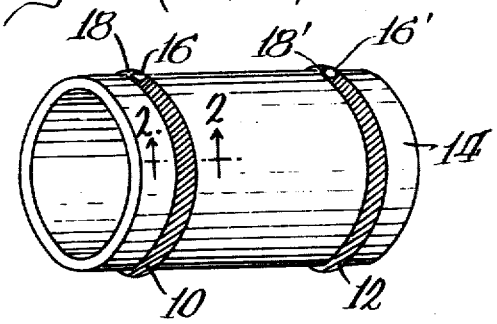
Fig. 1. (PRIOR ART)
Figure 2:
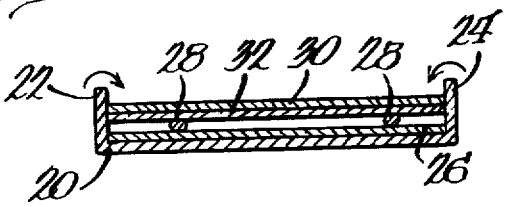
Fig. 2. (PRIOR ART)

Referring to FIGS. 1 and 2 of the drawings, heater bands 10 and 12 are secured to the surface of an extruder barrel 14 containing plastic for injection molding, for example. Terminals 16 and 18 or 16' and 18' are connected with an electrical power source, and the heating element in each of the heater bands 10 and 12 imparts sufficient heat through barrel 14 to maintain the plastic or other material in barrel 14 in a liquid state.

Referring to FIG. 2, a typical heater band, such as heater band 10, is shown to include a metal base 20 made of sheet metal or the like and having upwardly extending ears or tabs 22 and 24. An insulative sheet 26 extends along the base 20 and a heating element 28 is electrically insulated from metal cover 30 by an insulative sheet 32. After the metal cover 30 has been placed over sheet 32, the tabs or ears 22 and 24 are deformed inwardly, as shown by the arrows, to capture the metal cover 30, retaining it therebetween. A more detailed description of the method of making the heater band is found in Browne U.S. Pat. No. 2,976,387.

Although the heater band described above is satisfactory for many purposes, care must be taken to assure that the lower portion of the base 20 is in intimate contact with barrel 14 for efficient heat transfer therebetween. In the event there is a space or gap between the heater band 10 or 12 and the barrel 14, the heat from the heating element 28 cannot be sufficiently dissipated by base 20 and cover 30, causing heating element 28 to burn out. Because of the possibility of interrupted heat transfer between the heater band and an adjacent container, the wattage of the heating element is often limited to avoid an element burn-out.

DESCRIPTION OF THE PREFERRED EMBODIMENT

Figure 3:
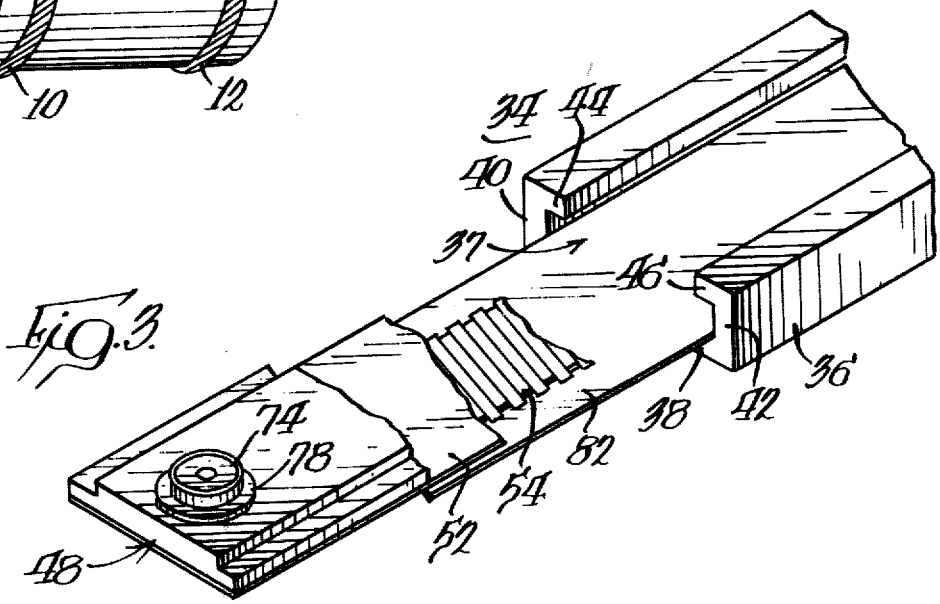
FIG. 3 is a perspective view, partly broken away, depicting the heater band of the present invention.
Figure 4:
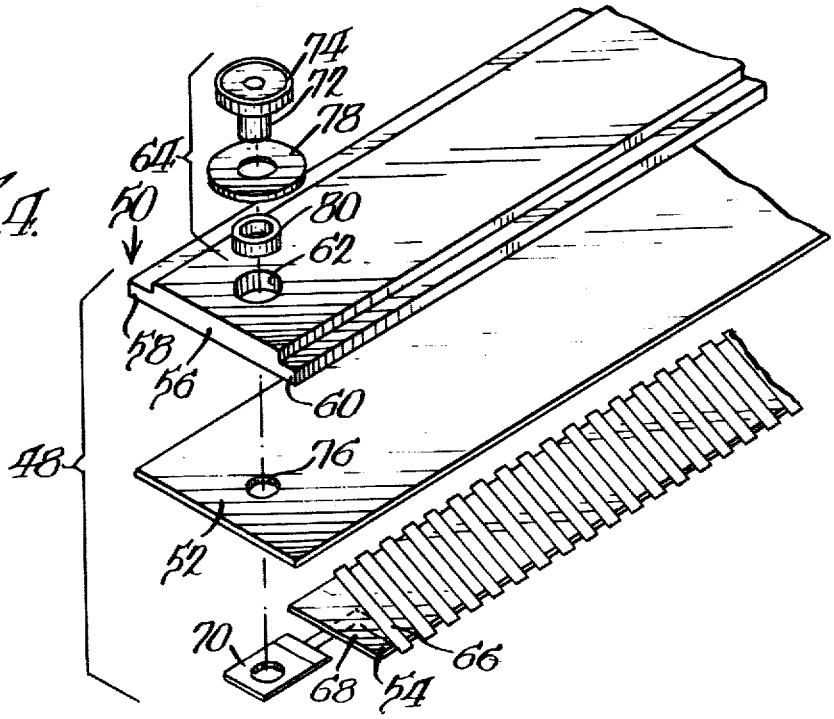
FIG. 4 is a detailed perspective view of the heater plate assembly of the heater band shown in FIG. 3.
Figure 5:
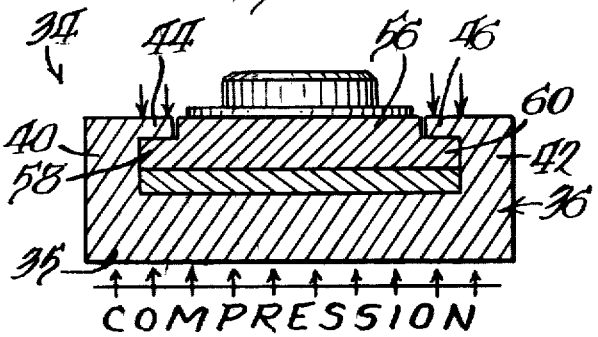
FIG. 5 is a cross-sectional view of the heater band in accordance with the present invention.

Referring to FIGS. 3–5, the heater band 34 includes a channel member 36 having a slot 37 extending along its length. Channel member 36 is preferably an extrusion and includes a base portion 38 and upstanding sides 40 and 42 having inturned flanges 44 and 46, respectively. The channel member 36 may be of any suitable material including aluminum, and its thickness, as ¼", is sufficient for dissipating heat.

A heater plate assembly 48 includes a cover 50, electrical insulating sheet 52 and heating element 54. The cover 50 includes a center core 56 and side portions 58 and 60 which extend outwardly from and have a thickness less than core 56. The width of the core 56 and the width of the side portions 58 are selected so that core 56 spans the distance between the ends of flanges 44 and 46, as best seen in FIG. 5. The side portions 58 and 60 are located beneath flanges 44 and 46. The thickness of core 56 and the thickness of the side portions 58 and 60 are selected so that the upper surface of the core 56 is substantially coincident with the surface formed by the upper portion of the flanges 44 and 46. The thickness of the side portions 58 and 60 is selected to fit beneath flanges 44 and 46. The cover 50 is provided with a bore 62 at each end to receive an electrical connector assembly 64, as will be explained below.

The heating element 54 includes a ribbon resistor 66 wrapped about a mica center 68, and is secured to a flat metallic connector 70.

The heater assembly 48 is assembled by laying the cover 50 over heating element 54 with electrical insulating sheet 52, as a mica sheet, therebetween. Connector assembly 64 retains the heating element 54 adjacent the cover 50 and provides an electrical connection to connector 70 of ribbon resistor 66. Specifically, a shank 72 of a terminal 74 extends through bore 62, a bore 76 in the insulating sheet 52, and through connector 70. The end of the shank is peened or soldered to mechanically and electrically engage the underportion of connector 70. Insulating washers 78 and 80 assure that the terminal 74 does not short with the cover 50.

Once the metal channel member 36 and the heater plate assembly 48 are formed, the assembly 48 is inserted into slot 37 of the channel member 36, as indicated in FIGS. 3 and 6. An insulating sheet 82, as mica, is disposed between the channel member 36 and the heater assembly 48 to electrically insulate the heating element 54 from the channel 36.

After inserting the heater assembly 48 into slot 37, the entire assembly is compressed, as by rolling, to form a highly dense cross section for good heat transfer. The compression is provided between the upper surfaces of the flanges 44 and 46 and the lower surface of the channel member 36, as indicated by the arrows in FIG. 5. After the heater plate assembly and the extrusion have been compressed, the ends of the heater band may be capped and welded to prevent the entry of contamination.

It is apparent that the heater band 34 may be employed as a straight length which can be provided with conventional fins secured thereto. The heater band 34 may also be formed in a semicircular configuration, as best seen in FIG. 7, having a radius to conform to the surface of a container to be heated. Alternatively, the heater band may be formed in a circle, as best seen in FIG. 8. If the semicircular or circular bands are to be adjacent a cylindrical container, conventional stainless steel external banding may be employed to assure intimate contact of the heater with the container.

I claim:

1. In a heater band of the type which includes an electrical resistance heating element surrounded on its top, bottom and sides by and electrically insulated from a metal jacket, an improved jacket comprising:

an integrally formed base including a bottom, two sides extending substantially perpendicular to and away from one surface of said bottom and flanges projecting inwardly parallel to said bottom to form a T-shaped slot between said flanges and between said flanges and said bottom; and a cover extending from side to side between said flanges and said bottom wherein said cover includes a central core disposed between a pair of side portions, all of which extend the length of said cover, said central core and said side portions having a common bottom planar surface disposed within said slot, said side portions further including upper surfaces disposed beneath said flanges, said central core and said flanges further including upper surfaces all of which are substantially coincident with one another to form a substantially flat surface across said flanges and said central core.

2. The improved heater band jacket of claim 1 wherein said bottom is rectangular in cross section.

3. The improved heater band jacket of claim 2 wherein said bottom is at least ¼" thick.

4. A heater band comprising:

a channel member of single-piece construction including:

a base;

upstanding sides formed with said base; and a flange projecting from each of said sides toward the opposite side to define a slot between said base and said flanges;

a heater assembly adapted to be received within said slot including:

a cover having a width substantially equal to the distance between said sides, including a central core disposed between a pair of side portions, all of which extend the length of said cover, said central core and said side portions having a common bottom planar surface disposed within said slot, said side portions further including upper surfaces disposed beneath said flanges, said central core and said flanges further including upper surfaces all of which are substantially coincident with one another to form a substantially flat surface across said flanges and said central core;

an electrical resistance heating element; and means for electrically insulating said heating element from said cover and said base.

5. A heater band comprising:

an extruded metal channel member including a base, sides extending upwardly from said base and flanges projecting inwardly from said sides to define a T-shaped slot between said base and said flanges and between said flanges;

a first electrical insulating sheet covering said base;

an electrical resistance heating element overlying said first insulating sheet;

a second electrical insulating sheet covering said heating element; and a metal cover retained in the slot and overlying said second insulating sheet in compressed relationship with said extruded channel member, said cover including a central core disposed between a pair of side portions, all of which extend the length of said cover, said central core and said side portions having a common bottom planar surface disposed within said slot, said side portions further including upper surfaces disposed beneath said flanges, said central core and said flanges further including upper surfaces all of which are substantially coincident with one another to form a substantially flat surface across said flanges and said central core.

6. The heater band of claim 5 wherein said base is rectangular in cross-section and at least ¼" thick.

* * * * *